United States Patent [19]

Grolla

[11] 3,970,137

[45] July 20, 1976

[54] APPARATUS FOR PRODUCING AND TRANSFERRING CASTING MOULDS

[75] Inventor: Herbert Grolla, Laasphe, Westphalia, Germany

[73] Assignee: Heinrich Wagner Maschinenfabrik, Laasphe, Westphalia, Germany

[22] Filed: Feb. 10, 1975

[21] Appl. No.: 548,600

[30] Foreign Application Priority Data

Feb. 15, 1974 Germany ..... 2407264

[52] U.S. Cl. ..... 164/160; 164/375; 164/409; 214/1 QD

[51] Int. Cl.[2] ..... B22C 25/00

[58] Field of Search ..... 164/7, 160, 375, 409; 214/1 QD

[56] References Cited

UNITED STATES PATENTS

| | | | |
|---|---|---|---|
| 3,832,117 | 8/1974 | Hijikata et al. | 164/160 X |
| 3,843,301 | 10/1974 | Hijikata et al. | 164/160 X |
| 3,861,447 | 1/1975 | Hondo | 164/160 X |

FOREIGN PATENTS OR APPLICATIONS

| | | | |
|---|---|---|---|
| 22,281 | 9/1969 | Japan | 164/375 |

*Primary Examiner*—Ronald J. Shore
*Assistant Examiner*—Gus T. Hampilos
*Attorney, Agent, or Firm*—Woodhams, Blanchard and Flynn

[57] ABSTRACT

An apparatus for producing and transferring casting moulds utilizing binderless sand subjected to a reduced pressure. The apparatus is comprised of a travelling gripper which is arranged to be raised and lowered and which is provided with two couplings to hold a moulding box. The couplings are rotatable about a horizontally extending axis with one coupling being connected to a vacuum pipe for evacuating the moulding box.

4 Claims, 3 Drawing Figures

APPARATUS FOR PRODUCING AND TRANSFERRING CASTING MOULDS

FIELD OF THE INVENTION

This invention relates to an apparatus for producing and transferring casting moulds with the aid of sand containing no binder.

BACKGROUND OF THE INVENTION

The use of disposable patterns consisting of films is known from German Offenlegungsschrift No, 1,926,163. These patterns can be produced in a simple manner by a known deep-drawing shaping process utilising reduced or elevated pressure. The patterns are introduced into a mounding box, whereupon the latter is filled with loose binderless sand. The sand is thereupon subjected to reduced pressure, so that the film of the pattern is pressed against the sand by the external air pressure. In this way it is possible to produce patterns of stable shape from very thin films. This stability of shape is however ensured in the case of thin films only as long as the reduced pressure is maintained in the sand. This method of casting has been found decidedly advantageous because the production of the patterns entails only little expense, a casting having a very smooth surface is obtained, and the preparation of the sand is not necessary. In order to remove the casting from the mould all that is necessary is to terminate the reduced pressure in the sand.

A prerequisite for the performance of the process described above is that the reduced pressure in the upper and lower parts of a two-part moulding box should be maintained from the completion of the pattern until the casting has been completely cooled. To this end it is known for the upper and lower boxes each to be provided with a flexible reduced pressure pipe. By means of these pipes a reduced pressure is maintained in both halves of the moulding box from the completion of the mould until the casting is removed from the mould.

For continuous production purposes the moulding boxes are placed on trucks of a closed-circuit rail conveyor which brings the moulding boxes to the various stations. The transfer of the moulding boxes, which are continuously connected to flexible reduced pressure pipes, is effected with the aid of gripping devices such as are described, for example, in the periodical "Giesserei 60" (1973) No. 21, page 664. The cycle sequence in which a rail conveyor of this kind can work depends on its length, that is to say on the number of rail conveyor trucks. The length of these known rail conveyors is above all limited by the reduced pressure pipes which are connected to the moulding boxes and which have been found to be a considerable hindrance. It is known for a rail conveyor of this kind to be made circular and for all the reduced pressure pipes leading to the moulding boxes to be connected to a centrally disposed reduced pressure pipe. A substantial disadvantage of the mould boxes continuously connected to the reduced pressue pipes is that manipulation thereof is restricted. If the moulding boxes are placed on rail conveyor trucks which are moved in timed sequence, the upper and lower boxes must be produced, brought together, and placed on the rail conveyor truck within a determined cycle time. This means that the time required for the production of the moulding boxes is also a decisive factor for the cycle times.

It is substantially more advantageous for the rail conveyor trucks to be provided with their own reduced pressure pipe connecting the rail conveyor trucks to one another. When the moulding boxes are placed on the trucks, they are then connected to the reduced pressure pipe of the trucks, so that the reduced pressure pipes connected to the moulding boxes during their manufacture can then be removed. A rail conveyor constructed in this manner has the advantage that it can be made in any desired length, since the reduced pressure pipe connected to the rail conveyor trucks has to be connected to a central reduced pressure pipe only at one point in each case. Another advantage is that the moulding boxes can be produced independently of the rail conveyor.

It is an object of the invention to provide an apparatus of the kind first mentioned above, with the aid of which casting moulds can be produced with the aid of binderless sand subjected to a reduced pressure, while maintaining the vacuum, and, for example, transferred to a rail conveyor.

According to the invention there is provided an apparatus for producing and transferring casting moulds utilising binderless sand subjected to a reduced pressure, said apparatus comprising a travelling gripper which is arranged to be raised and lowered and which is provided with two couplings to hold a moulding box, said couplings being rotatable about a horizontally extending axis, and one coupling being connected to a vacuum pipe for evacuating the moulding box. The coupling provided with the vacuum pipe acts on a projection which is provided on the moulding box and is connectable to the evacuation pipe of the latter. By means of this coupling the vacuum can be produced and maintained in the moulding box. Since with the aid of the apparatus of the invention both the lower part and the upper part of a moulding box can be produced, and the two parts can be brought together and placed on the rail conveyor, the apparatus makes it possible for the moulding boxes to be turned, transported, and deposited.

According to an advantageous embodiment of the invention, one of the two couplings is connected to means operable to rotate the moulding box about said horizontally extending axis. The said means advantageously comprises a toothed rack provided on a piston rod, and a pinion connected to the other of the couplings. The rotary drive is so designed that pivot movements through 180° are possible. For the hoorizontal displacement of the two couplings use is made of a double-action hydraulic cylinder.

BRIEF DESCRIPTION OF THE DRAWINGS

The invention will now be described, by way of example, with reference to the accompanying drawing, in which.

DETAILED DESCRIPTION

Figure 1:
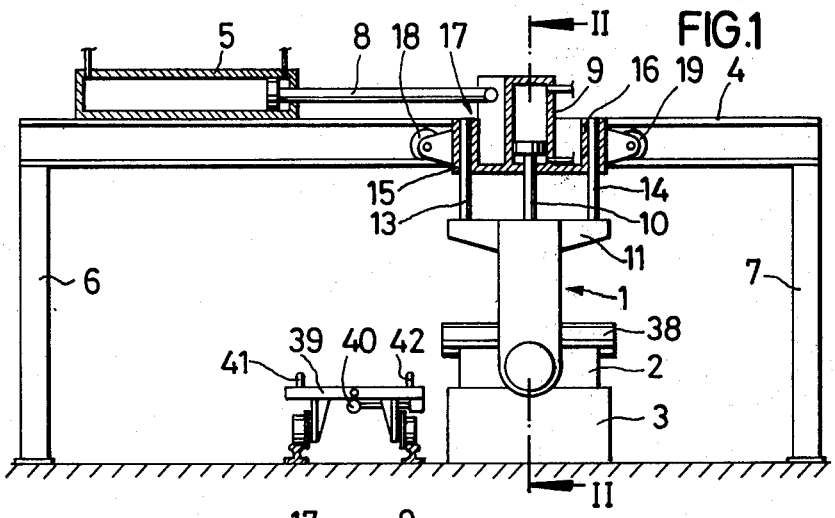
FIG. 1 diagrammaticaly illustrates apparatus according to the invention.

Referring to the drawing, the apparatus, which is indicated generally by the reference 1, comprises a moulding box 2, and a pattern unit 3. The apparatus 1 is carried by a support, which is indicated generally by the reference 4, and is raised above the ground by legs 6, 7 at the ends thereof. For the displacement of the apparatus 1 use is made of a double-action hydraulic cylinder 5 whose piston rod 8 acts on the apparatus 1.

A double-action hydraulic cylinder 9 serves to raise and lower the apparatus 1. The piston rod 10 of the cylinder 9 acts on a cross-member 11 of the apparatus 1. Guide rods 13, 14 are fastened on the cross-member 11 and are guided in guides 15, 16 forming part of a carriage 17 mounted on the support 4.

The carriage 17 has two rollers 18, 19 which are arranged in pairs and run on the inner flanges of I-section members 20, 21 of the support 4.

Figure 2:
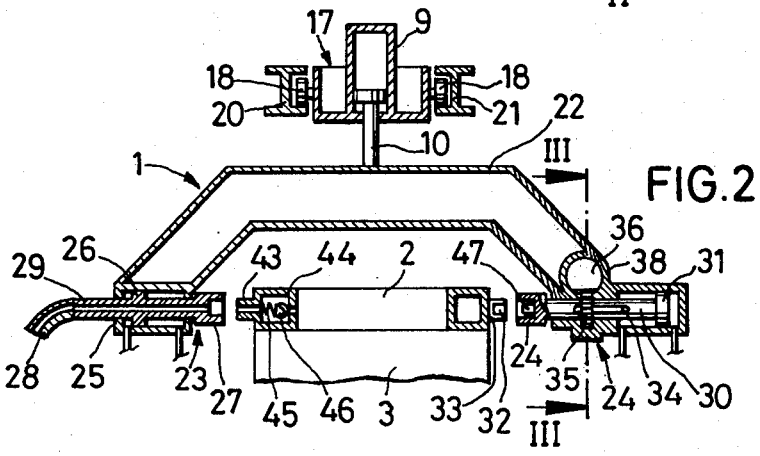
FIG. 2 is a section on the line II—II, FIG. 1.

The apparatus 1 includes a bow-shaped gripper 22, FIG. 2, at whose ends are disposed two couplings 23, 24 lying opposite one another. The coupling 23 also acts as the piston rod of a double-action hydraulic cylinder 25. The piston of the cylinder 25 is designated 26. The coupling 23 has a receiving head 27 which is connected to a vacuum pipe 28 by way of a bore 29 provided in the coupling.

Figure 3:
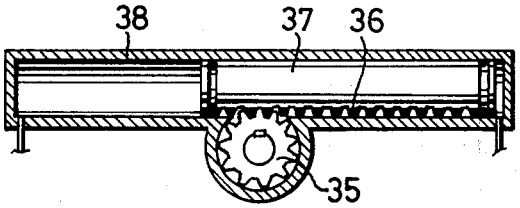
FIG. 3 is a section on the line III—III, FIG. 2.

The coupling 24 is fastened on a piston rod 30 of a double-action hydraulic piston 31. The coupling 24 is cupshaped and has a square extension 47 which is arranged to be engaged in a recess 32 in an extension 33 formed on the moulding box 2. A pinion 35 which is slidable in a slot 34 is fastened on the piston rod 30. The pinion 35 meshes with a rack 36. The rack 36 is part of a piston 37, FIG. 3, of a double-action cylinder 38. The length of the rack 36 is such that the moulding box 2 can be turned 180°.

At the side of the apparatus 1 a rail conveyor truck 39 of a rail conveyor is shown in FIG. 1. This rail conveyor truck has a vacuum pipe 40, which by means of a coupling 42 can be connected to the moulding box 2. A pin 41 also provided on the rail conveyor truck 39 serves to centre the moulding box 2.

The moulding box 2 consists of a frame 44, FIG. 2, on which two projections 32, 43 are formed. In the interior of the frame an evacuation passage is provided for evacuating sand introduced into the frame. The coupling 23 cooperates with the projection 43. The coupling 23 is connected to the vacuum pipe 28 and serves to evacuate the moulding box 2. The projection 43 provided on the moulding box is closed by means of a non-return valve consisting of a spring 45 and a ball 46. The non-return valve comes into operation when the moulding box 2 has been deposited on the rail conveyor truck and the evacuation has been taken over by the vacuum pipe 40 of the rail conveyor truck. As soon as the coupling 27 has been removed, the non-return valve 45, 46 forms a seal in relation to the atmosphere.

OPERATION

The mode of operation of the apparatus of the invention is as follows: when only one apparatus 1 is used, the lower box is made first and the upper box subsequently made separately. For this purpose, a film is first laid on a mask placed on the pattern box 3 and is adapted to its shape by vacuum and heat. A moulding box 2 is then brought up by means of the apparatus 1 and placed on the pattern box 3. The edges of the moulding box 2 thus lie on the film. The moulding box 2 is then filled with sand and a film is placed on the upper side of the moulding box 2. This film likewise lies sealingly on the frame of the moulding box 2. The interior of the moulding box 2 is then evacuated through the vacuum pipe 28 and the coupling 27 so that the films are pressed against the sand by the external air pressure. The production of the lower box is thus completed. The apparatus 1 is then raised, the moulding box is turned 180°, and then placed on the rail conveyor truck 40. As this is done the moulding box 2 is automatically connected to the vacuum pipe 40 of the rail conveyor truck, so that the coupling 27 can be disconnected. The upper box is thereupon produced in the same way and placed on the lower box. When the upper box is placed on the lower box, it is connected by another coupling (not shown) to the vacuum pipe 40 of the rail conveyor truck, so that the coupling 27 can be disconnected again. If the rail conveyor is to be operated with high cycle times it is advisable to dispose two apparatuses according to the invention serially; one of the two apparatuses is then used for moulding the lower box and the other for moulding the upper box.

The embodiments of the invention in which an exclusive property or privilege is claimed are defined as follows:

1. Apparatus for producing and transferring casting moulds utilising binderless sand subjected to a reduced pressure, said apparatus comprising a travelling gripper which is arranged to be raised and lowered and which is provided with two couplings to hold a moulding box, said couplings being rotatable about a horizontally extending axis, and one coupling being connected to a vacuum pipe for evacuating the moulding box.

2. Apparatus according to claim 1, wherein one of the two couplings is connected to means operable to rotate the moulding box about said horizontally extending axis.

3. Apparatus according to claim 2, wherein said means comprises a toothed rack provided on a piston rod, and a pinion connected to the other of the couplings.

4. Apparatus according to claim 1, wherein each of the two couplings is operated by a respective double-action cylinder.

* * * * *